United States Patent [19]

Shannon et al.

[11] Patent Number: 4,569,113

[45] Date of Patent: Feb. 11, 1986

[54] METHOD OF MAKING SEAT FOR RECREATIONAL SWING SET

[75] Inventors: William H. Shannon, Mentone; Wesley D. Sutton, Jr., Fort Payne, both of Ala.

[73] Assignee: Game Time, Inc., Fort Payne, Ala.

[21] Appl. No.: 689,721

[22] Filed: Jan. 8, 1985

Related U.S. Application Data

[62] Division of Ser. No. 525,872, Aug. 24, 1983, Pat. No. 4,524,966.

[51] Int. Cl.[4] ..... B23P 11/02

[52] U.S. Cl. ..... 29/446; 29/522 A; 29/526 A; 29/460; 264/279

[58] Field of Search ..... 29/446, 526 A, 452, 29/460, 522 A; 272/85; 264/262, 265, 279

[56] References Cited

U.S. PATENT DOCUMENTS

| | | | |
|---|---|---|---|
| 1,770,933 | 7/1930 | Leake | 29/452 UX |
| 1,863,073 | 6/1932 | Smythe | 29/452 UX |
| 3,165,308 | 1/1965 | Rathbun | 29/452 UX |
| 3,259,302 | 7/1966 | Racchisani | 29/446 UX |
| 3,503,308 | 3/1970 | Henry | 29/446 X |
| 3,669,484 | 6/1972 | Bernitz | 29/446 X |
| 3,897,056 | 7/1975 | Hock et al. | 272/85 |
| 4,066,258 | 1/1978 | Yates | 272/85 |
| 4,084,812 | 4/1978 | Melrose et al. | 272/85 |

FOREIGN PATENT DOCUMENTS

| | | | |
|---|---|---|---|
| 2063082 | 6/1981 | United Kingdom | 272/85 |

*Primary Examiner*—Charlie T. Moon

*Attorney, Agent, or Firm*—Lalos, Keegan, Marsh, Bentzen & Kaye

[57] ABSTRACT

A method of making a seat for a recreational swing set. A band of flexible material is flexed along a length thereof into a bowed orientation. At least one strand of flexible material is positioned along the length of this bowed band, and the ends of the strand are secured to the bowed band. The bowed band with the strands secured thereto is then allowed to flex back to its normal unflexed condition, placing the strand in tension and causing it to lie along the length of the band. The band with the strand secured thereto is then embedded in a body of flexible material.

6 Claims, 6 Drawing Figures

METHOD OF MAKING SEAT FOR RECREATIONAL SWING SET

This is a division of co-pending application Ser. No. 525,872 filed on Aug. 24, 1983, now U.S. Pat. No. 4,524,966.

This invention relates to playground and park equipment and more particularly to an improved seat construction or a recreational swing set. The invention further contemplates an improved method of making such a seat construction.

In the prior art, there has been developed a swing seat generally consisting of an elongated body of flexible material such as rubber, an insert consisting of a band of metal embedded in the elongated body of flexible material which imparts form and strength to the body of flexible material and a pair of openings fitted with metal grommets in the ends of the body of flexible material for attaching the seat to a pair of depending ropes, chains or poles, in the conventional manner.

In the use of the type of swing seat as described, it has been found that vandals often will cut away the outer rubber material of the seat, exposing the metal insert, and that repeated flexing of the metal insert will cause it to break, rendering the swing useless. It thus has been found to be desirable to provide a swing seat construction of the type described which will remain in tact and functional even after the outer body of flexible material thereof has been cut or broken away, perhaps as a result of vandalism, and the embedded metal insert has been repeatedly flexed and broken.

Accordingly, it is the principal object of the present invention to provide an improved seat construction.

Another object of the present invention is to provide an improved seat suitable for use in recreational swing sets found in children's playgrounds and parks.

A further object of the present invention is to provide an improved seat for swing sets, of the type having a flexible metal inserted embedded in a body of flexible material.

A still further object of the present invention is to provide a seat construction for use with a recreational swing set, having a flexible metal insert embedded in a body of flexible material such as rubber, wherein the seat will remain substantially intact and functional after the outer body of flexible material has been cut or broken away and the embedded metal insert has been repeatedly flexed and broken.

Another object of the present invention is to provide an improved method of making a seat suitable for use with recreational swing sets.

Other objects and advantages of the present invention will become more apparent to those persons having ordinary skill in the art to which the present invention pertains from the following description taken in conjunction with the accompanied drawings, wherein.

Figure 1:
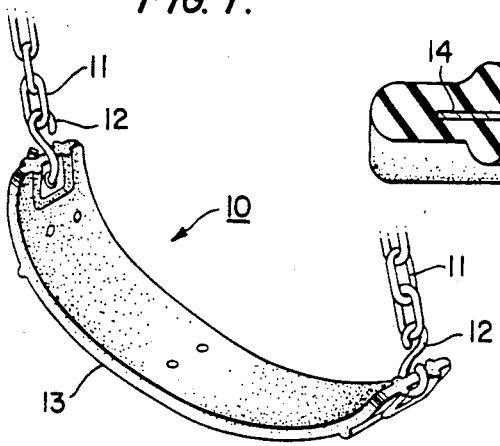
FIG. 1 is a partial view of a swing set including a seat component embodying the present invention.

Referring to FIG. 1 of the drawing, there is illustrated a seat 10 embodying the present invention which is adapted to be connected to the lower ends of a pair of depending chains 11 of a swing set by means of a pair of S-shaped connecting hooks 12, in the conventional manner. Seat 10 generally consists of a body of flexible material 13, an insert 14, a plurality of strands 15 and a pair of connecting fittings 16. Body 13 of the seat has an elongated, substantially flat configuration with a width and length suitable to permit a child or teenager to be seated thereon. It may be constructed of any suitable material although it is preferred that it be constructed of rubber which provides a sufficient strength, flexibility and durability. It is contemplated that the body of flexible material, usually rubber, be molded in the conventional manner.

Insert 14 is embedded in body 13 and is formed of a material having a stiffness greater than the stiffness of the material of which the body 13 is formed to impart form and strength to outer body 13. Preferably, the insert consists of a band of spring steel which is pliable but which maintains form and imparts strength to the outer body of rubber material in which it is embedded.

The structural integrity of the seat is enhanced by strands 15, each of which consists of a steel wire, rope or cable having steel eyelets 17 crimped on the ends thereof. The strands are disposed longitudinally, spaced transversally and secured to the insert by spot welding the eyelet portions thereof to the steel insert in a manner described below.

Figure 3:
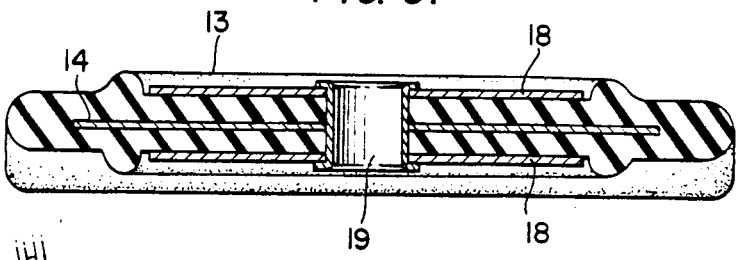
FIG. 3 is an enlarged, cross sectional view taken along line 3—3 in FIG. 2.
Figure 2:
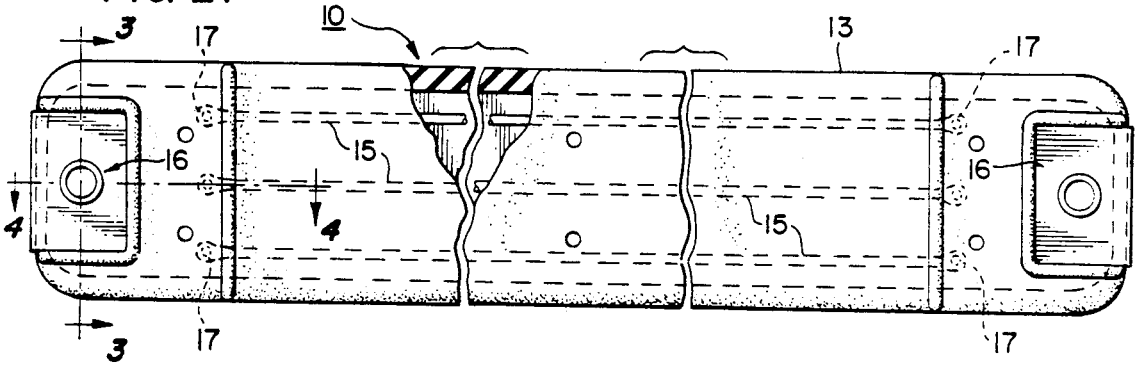
FIG. 2 is an enlarged, top plan view of the seat component shown in FIG. 1, having portions thereof broken away.
Figure 4:
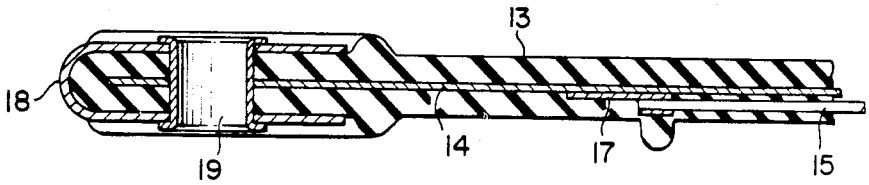
FIG. 4 is an enlarged, cross sectional view taken along line 4—4 in FIG. 2.

Each of the connecting fittings 16 consists of a U-shaped base member 18 and a grommet 19. As best illustrated in FIGS. 3 and 4, each U-shaped base member straddles an end portion of body 13 with the leg portions thereof engaging upper and lower end surfaces of body 13, and the associated grommet is disposed in registered openings in the leg portions of the U-shaped base member, and the end portions of body 13 and insert 14, having the outer annular portions crimped firmly into engagement with the leg portions of the U-shaped base member.

Figure 5:
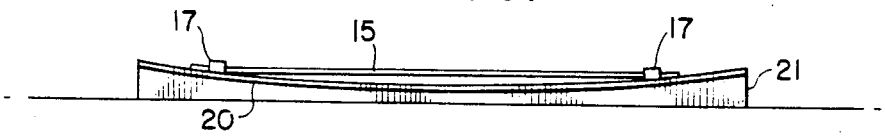
FIG. 5 is a side elevational view of a fixture utilized in practicing the method of making a seat, embodying the present invention.
Figure 6:
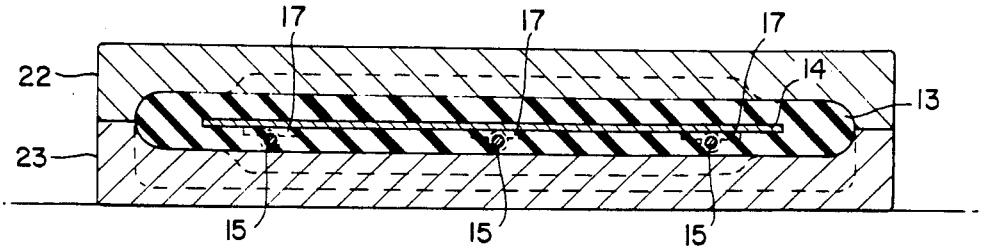
FIG. 6 is a vertical cross sectional view of a mold, taken along a transverse plane, utilized in practicing the method embodying the present invention.

In the manufacture of a seat member as described, the steel insert is first mounted on an upper, concave or bowed surface 20 of a fixture 21 as shown in FIG. 5. Three strands of steel wire, rope or cable 15 having steel grommets 17 are then positioned on the steel insert so that they are disposed longitudinally and spaced transversally relative to the steel insert. The eyelet portions of the strands are then spot welded to the steel inserts. When the steel insert with the welded strands is then removed from fixture 21 and placed on a flat surface, the steel insert will flex to its normal extended condition to place the strands in tension.

The steel insert with the tensioned strands is then placed with strips of rubber in the cavities of a pair of mold sections 22 and 23. Heat and pressure is then applied to the mold sections to cause the rubber to soften and flow, and fill the mold cavities, embedding the metal insert and attached strands. As the rubber is heated and caused to flow within the mold cavities, the strands will be prevented from floating and becoming displaced by virtue of having the ends thereof welded to the metal insert and having been placed in tension in the manner as aforesaid.

The seat member as described is adapted to be connected to a pair of depending chains 11 by means of a pair of S-shaped bolts 12 which are adapted to be inserted into the end openings provided by grommets 19. In use, the steel insert will function to maintain the form and enhance the strength of the rubber body yet provide sufficient fiexibility to permit the seat to conform to different sizes of users. Whenever the outer rubber body of the seat becomes cut, worn or otherwise broken away, exposing the steel insert, the strands of steel wire, rope or cable will function to maintain the seat intact and functional, even after the steel insert has been repeatedly flexed to the point where it may be caused to break.

While it is preferred that the insert be formed of steel and the strands be formed of steel wire, rope or cable, with the outer body in which the insert and strands are embedded be formed of rubber, it is to be understood that other comparable materials also can be used within the scope of the invention. The material in which the insert and strands are embedded, however, should be formed of a flexible material to accommodate bending and conform to different sizes of users, and the insert should be of a material having a greater stiffness than the outer body material to maintain the form and enhance the strength of the outer body portion of the seat.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. A method of making a swing seat comprising flexing a band of flexible material along a length thereof into a bowed orientation, positioning at least one strand of flexible material along the length of said bowed band, securing the ends of said strand to said bowed band, allowing the bowed band with said strands secured thereto to flex back to its normal unflexed condition, placing said strand in tension and causing it to lie along the length of said band, and embedding said band with said strand secured thereto in a body of flexible material.

2. A method according to claim 1 wherein said flexible band is placed in a bowed condition by placing it in a fixture having a concave seating surface.

3. A method according to claim 1 wherein said band with said strand secured thereto is embedded in said flexible body by molding.

4. A method according to claim 3 wherein said band with said strand secured thereto is placed in a mold cavity in an unflexed condition and said strand disposed in tension.

5. A method according to claim 4 wherein metallic materials are used for said band and strand, said strand ends are welded to said band, and said band and weld are molded in a rubber material.

6. A method according to claim 5 wherein said metallic strand is provided with metallic eyelets which are welded onto said metallic band.

* * * * *